United States Patent [19]

Schattner et al.

[11] 4,348,967

[45] Sep. 14, 1982

[54] PUBLIC SECURITY LOCKER

[75] Inventors: Robert L. Schattner, Marlton, N.J.; Allen S. Schattner, Pittsburgh, Pa.

[73] Assignee: Omnimed, Inc., Maple Shade, N.J.

[21] Appl. No.: 190,514

[22] Filed: Sep. 25, 1980

[51] Int. Cl.[3] ..... E05G 1/04

[52] U.S. Cl. ..... 109/51; 109/74

[58] Field of Search ..... 109/50, 51, 52, 59 R, 109/64, 74; 312/234.1

[56] References Cited

U.S. PATENT DOCUMENTS

| | | | |
|---|---|---|---|
| 345,302 | 7/1886 | Hayes et al. | 109/51 |
| 404,458 | 6/1889 | Woodruff | 312/234.1 |
| 1,546,884 | 7/1925 | Burnett | 109/50 |
| 2,180,997 | 11/1939 | Rubilino | 109/64 |
| 3,426,707 | 2/1969 | Heyl | 109/59 |
| 3,871,197 | 3/1975 | Waxgiser | 109/64 |

*Primary Examiner*—Reinaldo P. Machado

*Attorney, Agent, or Firm*—Leitner, Palan, Martin & Bernstein

[57] ABSTRACT

A security locker for mounting in a public area having a combination lock whose combination may be secretly and personally selected by each of a plurality of short-term users. The door is pivotally mounted to form a shelf in its fully opened position.

7 Claims, 4 Drawing Figures

PUBLIC SECURITY LOCKER

BACKGROUND OF THE INVENTION

The present invention relates generally to security lockers and more specifically to an improved security locker for use in a public place by a plurality of short-term users.

In most public places, for example, airports, train stations, bus stations, and secure areas, security lockers are provided for rental. The public short-term user will insert a coin which will allow them to remove a key and lock the contents of their valuables within the security locker. Although providing a secure place for their valuables, a key lock is readily picked and the key is not personalized to the user. Also someone obtaining a master key may unlock any of the security lockers in a public area. The key may also be lost by the renter.

In other areas used by the general public, for example, hospitals and/or hotels, the patient or guest is generally very hesitant to turn over or trust their valuables to the employees of the hospital and/or hotel for storage in a central safe due to a general anxiety about relinquishing possession. Also the patient/guest generally wants convenient access to their valuables and money. Thus the valuables are usually hidden somewhere in the room and thus are easily stolen by the hospital employees as well as professional thieves. There exists a need for a security locker in hospitals or hotel rooms which can be personalized by a plurality of short-term users.

SUMMARY OF THE INVENTION

An object of the present invention is to provide a security locker which can be personalized by a plurality of short-term users.

Another object of the present invention is to provide a security locker which may be conveniently installed in public areas, for example, hotel rooms or hospital rooms.

A further object is to provide a security locker with a shelf to aid inspection of valuables.

These and other objects of the present invention are attained by a security locker provided in the public area which includes a combination lock which may be secretly personalized by the short-term user. The security locker includes a housing having a back wall, two side walls, a top wall, a bottom wall, and a front wall. The front wall includes an access opening covered by a door pivotally mounted thereto. The door rotates about a horizontal axis and is limited by a flexible element or a slidably mounted rigid element to a horizontal fully open position to function as a shelf. The door includes a perpendicularly extending rim and an interior flange to encompass the edges of the top and side walls to increase the security of the housing. A plate extends across the flanges to provide a double panel door. A combination lock is opened or locked by manipulating the dials from the exterior of the housing and the combination is preselected by a mechanism accessible only when the door is open.

Other objects, advantages and novel features of the present invention will become apparent from the following detailed description of the invention when considered in conjunction with the accompanying drawings.

DESCRIPTION OF THE PREFERRED EMBODIMENTS

Figure 1:
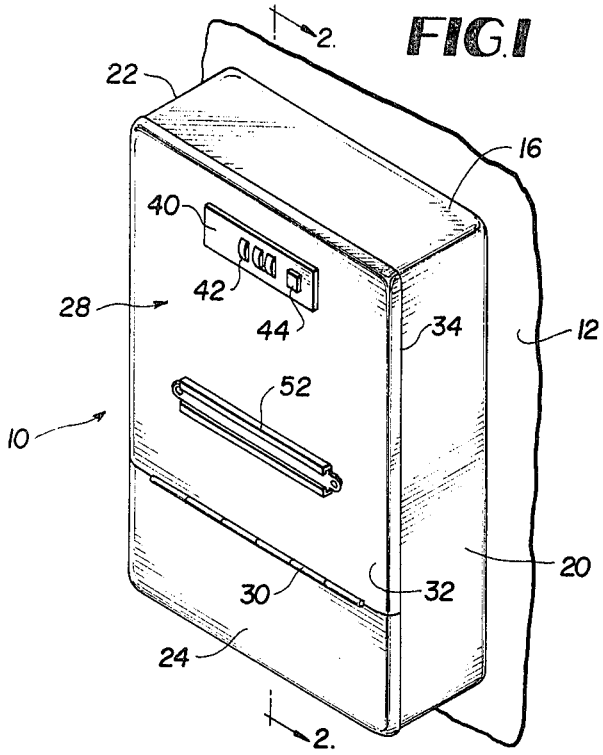
FIG. 1 is a perspective view of a security locker incorporating the principles of the present invention mounted to a structure.
Figure 2:
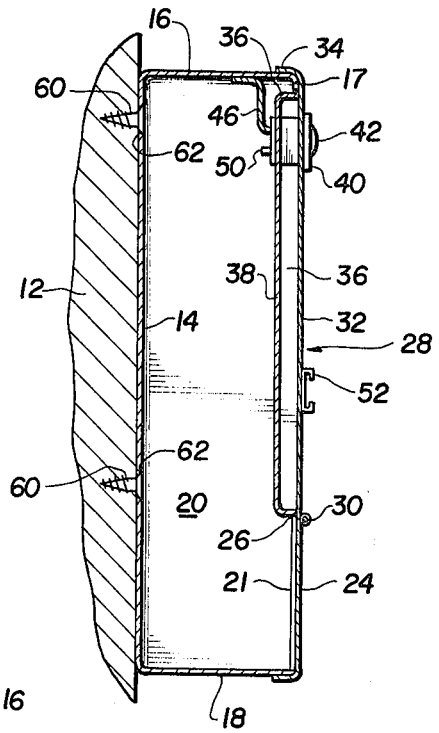
FIG. 2 is a cross-sectional view of the security locker of FIG. 1 taken along lines 2—2.
Figure 3:
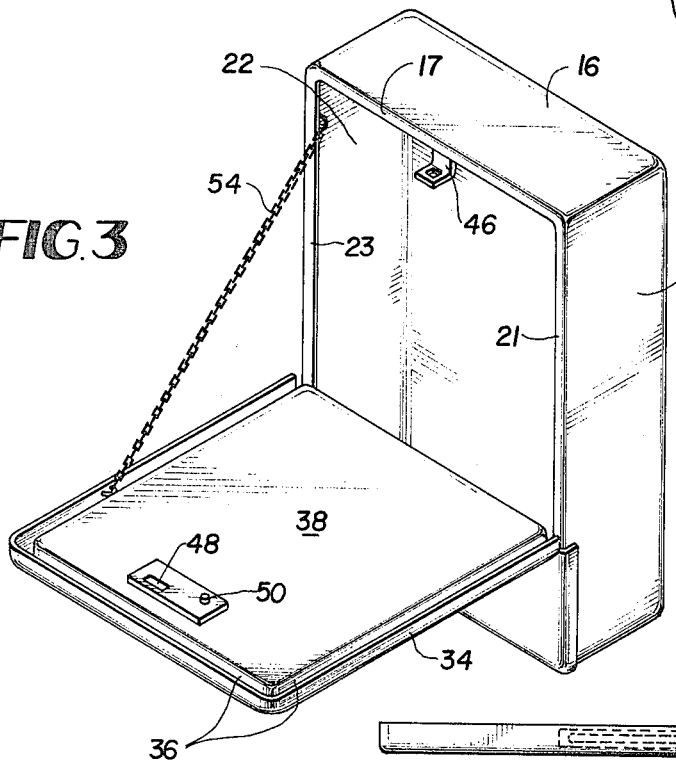
FIG. 3 is a perspective view of a security locker incorporating the principles of the present invention with the door in the open position.

As illustrated in FIGS. 1 through 3, a security locker incorporating the principles of the present invention is mounted to a support 12 which may be a wall or a piece of furniture in a public area. The security locker 10 includes a housing having a back wall 14, a top wall 16, a bottom wall 18, side walls 20 and 22, and a front wall 24. An opening 26 in the front wall 24 provides access to the interior of the housing. A door 28 which is pivotally mounted by hinge 30 to the front wall 24 includes a base portion 32 with a rim 34 extending around the periphery thereof. Also mounted to the base portion 32 of the door 28 is a flange 36 to which is mounted a plate 38. The combination of base 32 and plate 38 forms a double panel door for increased security. As illustrated in FIG. 3, the flange 36 is spaced from the rim 34 to define a channel therebetween which receives the flanged end-portions 17, 21 and 23 of top and side walls 16, 20 and 22, respectively, when the door is in the closed position. This also increases the security of the security locker by reducing the ability of the door to be pried open.

Mounted to door 28 adjacent the top thereof is a combination lock 40 having a plurality of dials 42 and a bolt actuator 44. A keeper 46 is mounted to the interior of the top wall 16 and is received in an opening 48 in the rear of the lock 40. The bolt actuator 44 moves the bolt (not shown) to engage and disengage the keeper 46 so as to secure the door 28 closed. The actuator 44 is enabled or disabled depending upon the combination of symbols presented on the dials 42. A knob 50 on the back of the lock provides the ability that a user can determine the sequence of symbols which define the combination for the dials 42. This allows the lock and the security locker to be individually and secretly personalized by the short-term user. A combination lock having this capability is Catalog No. 04-2971-0-233-0 by Presto Lock of Garfield, N.J.

Mounted to the face of door 28 is a bracket 52 which is capable of receiving an information bearing substrate to identify the short-term user. In use in a hospital, the dimensions of the bracket 52 may be selected to receive a patient I.D. strip equivalent to that in the patient I.D. bracelets.

Figure 4:
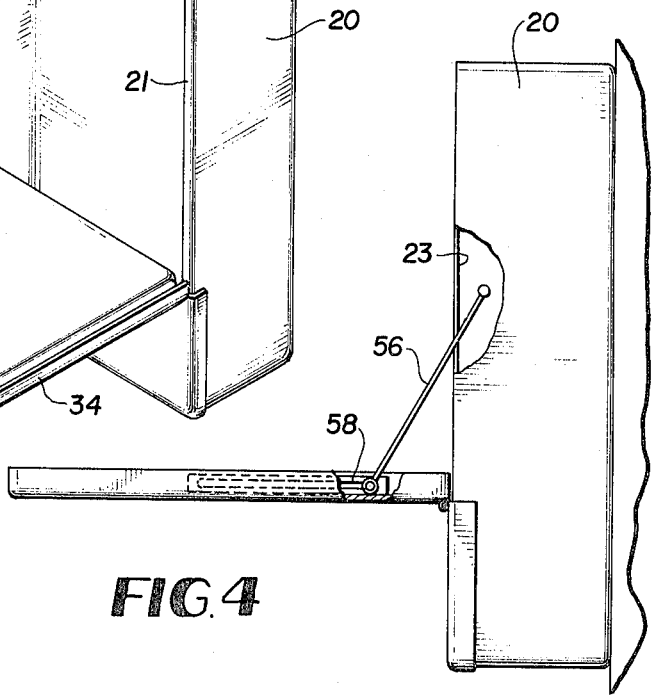
FIG. 4 is a side view of another embodiment of a security locker incorporating the principles of the present invention with the door in the open position.

To increase the versatility of the security locker 10, a flexible element 54 is interconnected between the door 28 and the security locker to limit the extreme open position of the door 28 to a substantially horizontal position. This allows the door 28 to act as a shelf. As illustrated in FIG. 3, the flexible element 54 is a chain. Other flexible elements may be used, for example, a wire. Another interconnecting element which may be used is illustrated in FIG. 4 as a rigid rod 56 pivotally connected at one end to the housing and whose other end is slidably received within a guide 58 on the door 28. This other end of the rod 56 rests against one end of the guide 58 to provide a stop limiting the pivotal open position of the door 28 to a substantially horizontal position. Although FIGS. 3 and 4 illustrate two types of elements which interconnect the door and the security locker to limit the open position of the door, other types of elements may be used.

As illustrated in FIG. 2, the security locker 10 is mounted to the support 12 by fasteners 60 through apertures 62 in the back wall 14. The apertures 62 form a template for drilling starter holes for the fasteners 60.

From the preceding description of the preferred embodiments, it is evident that the objects of the invention are attained in that a security locker is provided in a public place which can be secretly personalized by the short-term user. Although the invention has been described and illustrated in detail, it is clearly understood that the same is by way of example and illustration only and is not to be taken by way of limitation. The spirit and scope of the present invention are to be limited only by the terms of the appended claims.

What is claimed:

1. A security locker for use by the public comprising:

a housing having a back wall, two side walls, a top wall and a front wall;

said front wall having a stationary portion and an opening providing access to the interior of said housing;

a door pivotally mounted at its bottom to said stationary portion of said front wall to pivot about a horizontal axis (housing) for covering said opening, wherein said stationary portion of said front wall and said door include a base portion and a rim portion extending from the periphery of said base portion toward said housing, the periphery exterior of said top, bottom and two side walls being enclosed by said base and rim portion of said stationary portion of said front wall and said door, when said door is in the closed position;

combination lock means for locking said door closed to said housing;

dial means of said lock means accessible from the exterior of said housing for locking said lock means when said dial means does not have a predetermined sequence of symbols and unlocking said door when said dial means has said predetermined sequence of symbols;

setting means unaccessible from the exterior of said housing when said door is closed for changing said predetermined sequence whereby the sequence can be secretly personalized by each of a plurality of short-term users; and fastener means for permanently mounting said housing to a pre-existing structure in an area used by the public.

2. The security locker according to claim 1 further including a means interconnecting said housing and said door for limiting the open position of said door to a horizontal plane through said horizontal axis.

3. The security locker according to claim 2 wherein said limiting means includes a flexible element secured at one end to the interior of said housing and at its other end to the interior of said door, the length of said flexible element limits said door's open position and provides support.

4. The security locker according to claim 2 wherein said limiting means includes a guide mounted to the interior of said door and a rigid rod pivotally connected at one end to the interior of said housing and slidably connected at its other end to said guide, said rod and guide limits said door's open position and provides support.

5. The security locker according to claim 1 wherein said door includes a base portion and a rim portion extending from the periphery of said base portion toward said housing, a flange spaced from said rim and extending from said base in the same direction as said rim, said periphery of said top and two side walls are received in the space between said rim and flange when said door is in said closed position.

6. The security locker according to claim 5 including a plate extending across said flanges of said door to form a double panel door.

7. The security locker according to claim 1 including means on said housing for receiving a substrate having user identifying information thereon.

* * * * *